US008419453B2

(12) United States Patent
Chiang

(10) Patent No.: US 8,419,453 B2
(45) Date of Patent: Apr. 16, 2013

(54) CABLE CONNECTOR

(75) Inventor: Chih-hsien Chiang, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/239,386

(22) Filed: Sep. 21, 2011

(65) Prior Publication Data

US 2013/0072045 A1 Mar. 21, 2013

(51) Int. Cl.
*H01R 13/62* (2006.01)

(52) U.S. Cl.
USPC ..... 439/157

(58) Field of Classification Search ..... 439/347, 439/310, 152–160, 496, 495, 494, 260, 261
See application file for complete search history.

(56) References Cited

U.S. PATENT DOCUMENTS 5,476,390 A * 12/1995 Taguchi et al. ..... 439/157
7,040,917 B2 * 5/2006 Yagi et al. ..... 439/495
2009/0163067 A1 * 6/2009 Niitsu ..... 439/329

* cited by examiner

*Primary Examiner* — Tulsidas C Patel
*Assistant Examiner* — Phuongchi Nguyen
(74) *Attorney, Agent, or Firm* — Cheng-Ju Chiang

(57) ABSTRACT

A cable connector is disclosed. The cable connector includes a male connector and a female connector. The male connector includes a male base and male terminals received in the male base. The female connector includes a female base and female terminals locked with the female base. Two posts respectively protrude outwardly from ends of two side walls of the male base. Two locking slots which are tilting are respectively defined in the middles of two side walls of the female base. When assembled, the male base is pushed so that the posts are respectively locked with the corresponding locking slots. The male base of the present invention is steadily locked with the female base. Furthermore, the male base of the present invention is disassembled from the female base by pushing the male base, so that the posts are withdrawn from the locking slots.

5 Claims, 6 Drawing Sheets

CABLE CONNECTOR

BACKGROUND OF THE INVENTION

1. Field of the Invention

The present invention generally relates to a connector, and more particularly to a cable connector.

2. Description of Prior Art

Cable connectors are widely used in network communication equipment. A cable connector is disposed on a circuit board. The cable connector provides a disposal space for cables inserted therein and comprises conductive terminals which are electrically connected to the circuit board for data transmission.

A conventional cable connector generally comprises a female connector disposed on a circuit board and a male connector connected to cables. A connection between the female connector and the male connector is usually implemented by an embedding method. For example, at least one positioning post is disposed on a side surface of the male connector, and at least one positioning slot is disposed on the female connector. The positioning post is plugged into the positioning slot. However, this direct plug-in method is not steady enough. When the cables are pulled and dragged upwardly, the positioning post is easily removed from the positioning slot and thus the male connector and the female connector are separated. Furthermore, sometimes the cables are easily broken when the cables are pulled. The above-mentioned problems lead to electrical disconnection between the female connector and the male connector, and thus the data transmission is affected.

Thus, there is a need for a solution to provide an improved cable connector so that the structure connection between the male connector and the female connector is steady and the electrical connection between the male connector and the female connector is stable.

SUMMARY OF THE INVENTION

To solve the above-mentioned deficiencies in the prior arts, an objective of the present invention is to provide a cable connector so that the structure connection between a male connector and a female connector is steady and the electrical connection between the male connector and the female connector is stable.

To implement the above-mentioned objective, the cable connector in accordance with to an aspect of the present invention comprises a male connector and a female connector. The male connector comprises a male base and a plurality of male terminals received in the male base. The male terminals are connected to a plurality of cables. The female connector comprises a female base and a plurality of female terminals locked with the female base. Two posts respectively protrude outwardly from ends of two side walls of the male base. Two locking slots which are tilting are respectively defined on two side walls of the female base for corresponding to the posts. The posts are locked with the locking slots. The male terminals contact with the female terminals.

As mentioned above, in the cable connector in accordance with the present invention, the two locking slots which are tilting are respectively defined on the two side walls of the female base, and the two posts respectively protrude outwardly from ends of two side walls of the male base. When assembled, the male base is pushed so that the posts respectively slide in and are locked with the corresponding locking slots. Compared with the conventional direct plug-in method, the male base of the present invention is steadily locked with the female base. Furthermore, the male base of the present invention is disassembled from the female base by pushing the male base, so that the posts are withdrawn from the locking slots. Compared with the conventional disassembled method by pulling and dragging cables, the cables of the present invention are not broken and the electrical connection performance of the cable connector is improved.

DETAILED DESCRIPTION OF THE INVENTION

Figure 1:
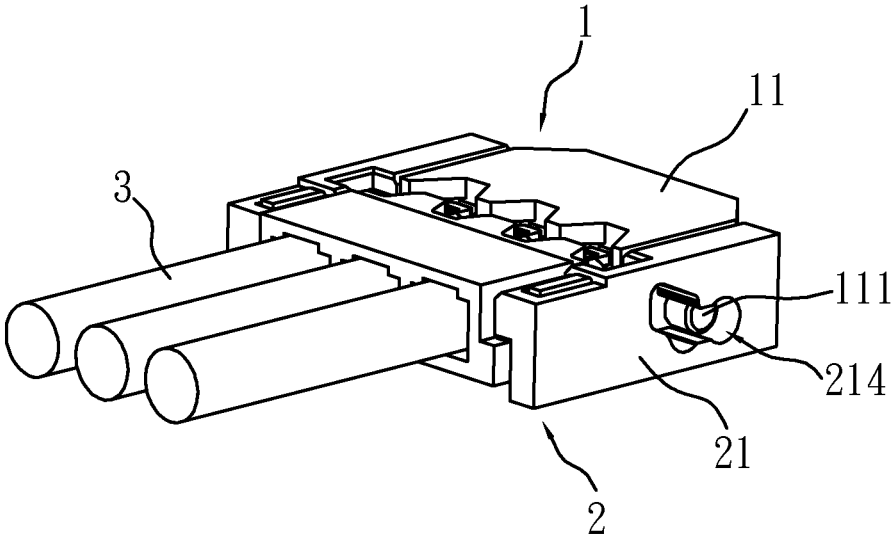
FIG. 1 is a perspective view of a cable connector in accordance with the present invention.
Figure 2:
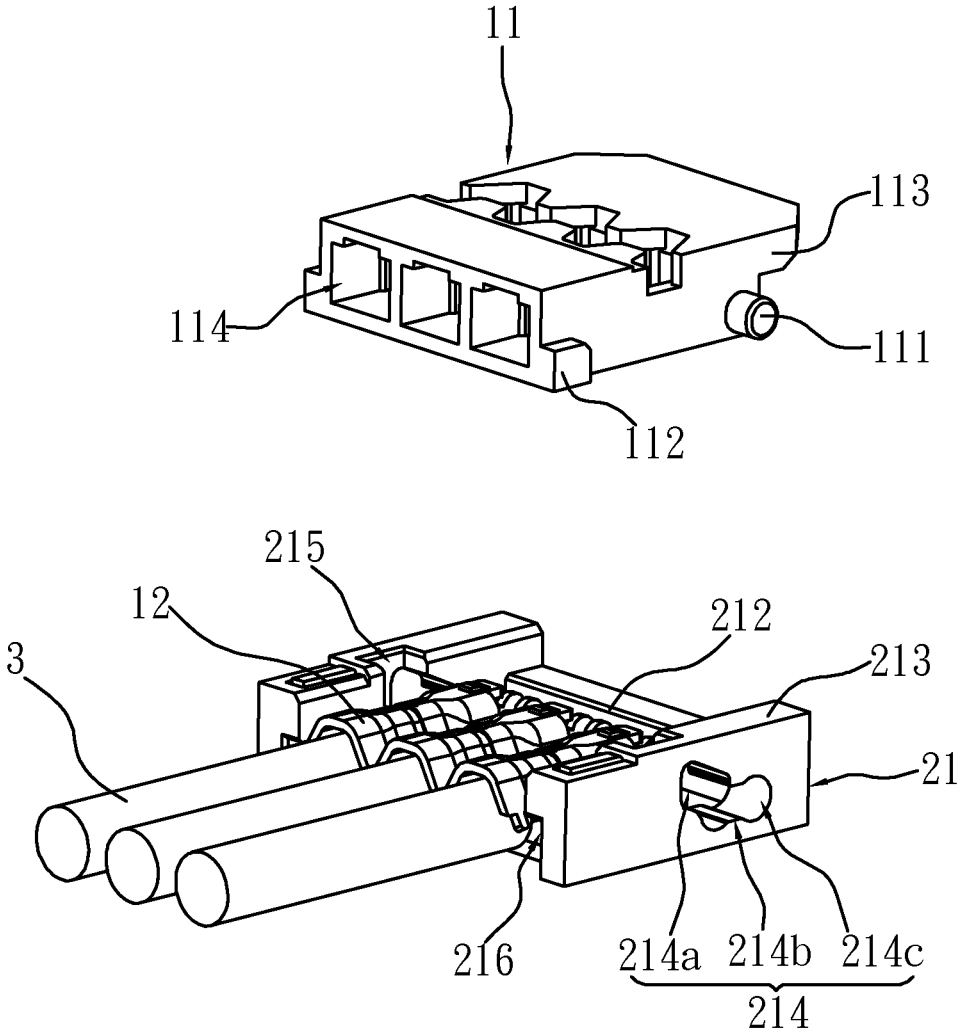
FIG. 2 is an exploded view of the cable connector in accordance with the present invention.
Figure 3:
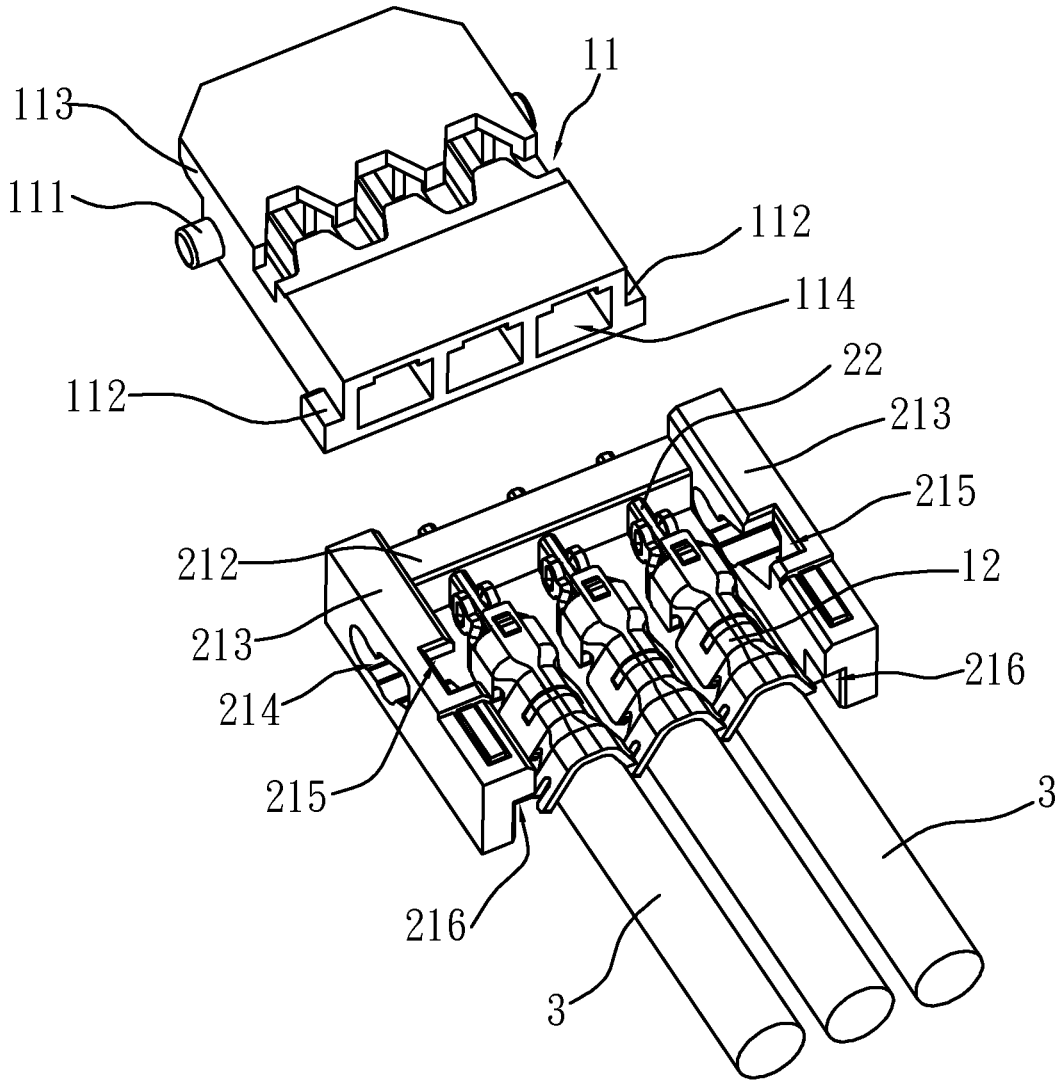
FIG. 3 is another exploded view of the cable connector in accordance with the present invention.

Please refer to FIGS. 1-3, a cable connector in accordance with the present invention comprises a male connector 1 and a female connector 2. The male connector 1 comprises a male base 11 and a plurality of male terminals 12 received in the male base 11. The male terminals 12 are connected to a plurality of cables 3. The female connector 2 comprises a female base 21 and a plurality of female terminals 22 locked with the female base 21. Two posts 111 respectively protrude outwardly from rear ends of the two side walls of the male base 11. Two locking slots 214 which are tilting are respectively defined in the middles of two side walls 213 of the female base 21 for corresponding to the two posts 111. The posts 111 slide along the corresponding locking slots 214 to be locked with the locking slots 214. The male terminals 12 contact with the female terminals 22.

Figure 4:
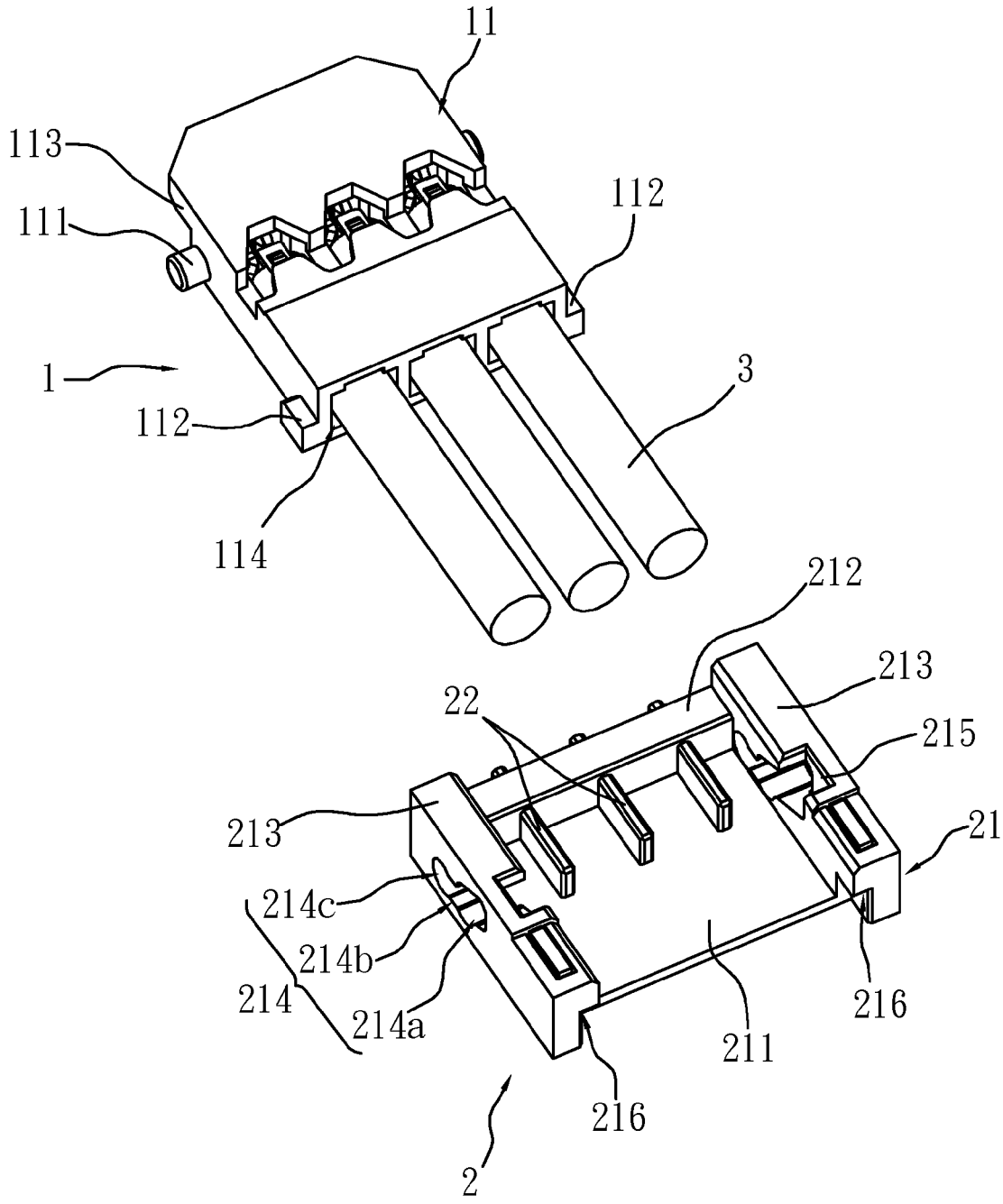
FIG. 4 is another exploded view of the cable connector in accordance with the present invention.
Figure 5:
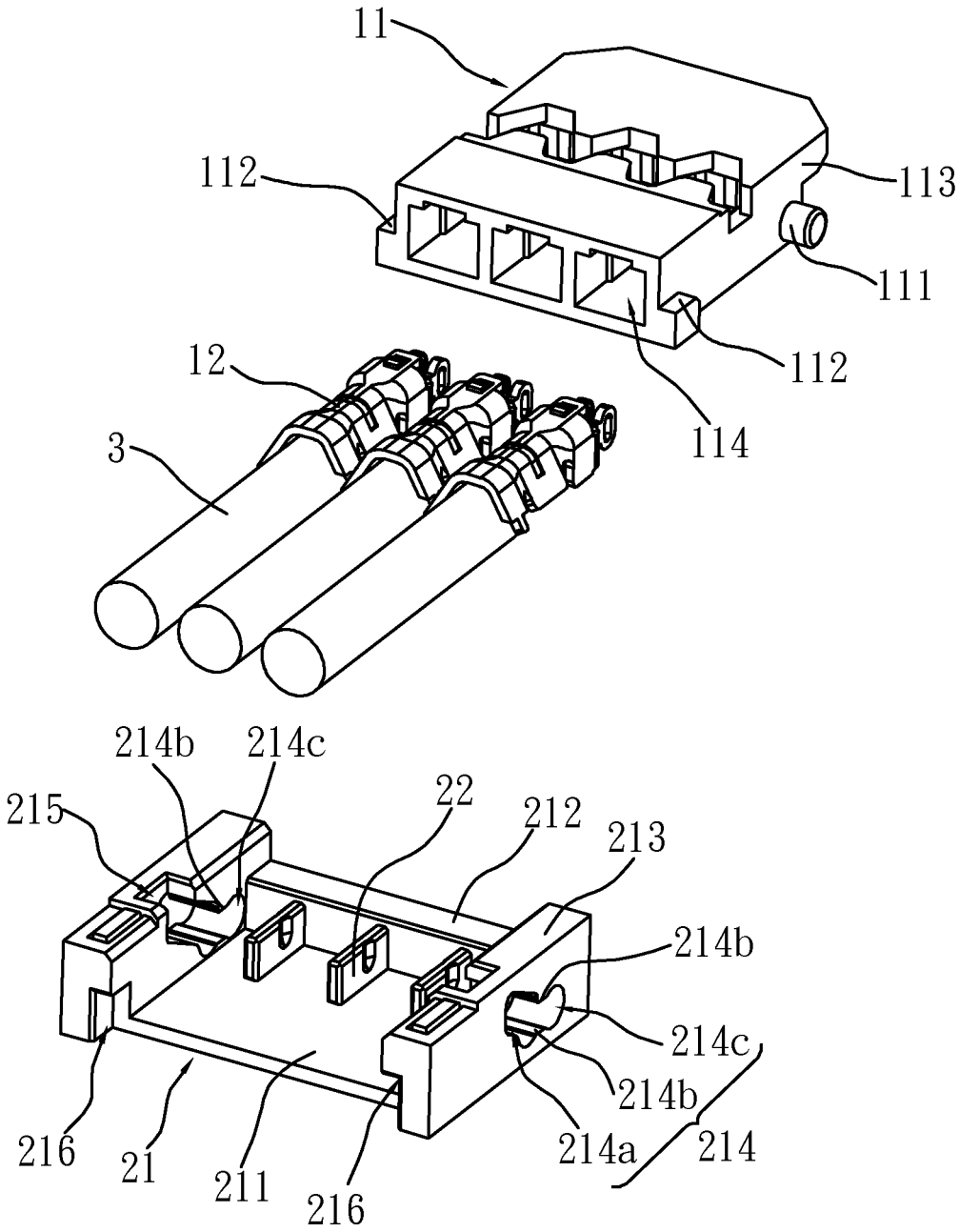
FIG. 5 is another exploded view of the cable connector in accordance with the present invention.

Please refer to FIGS. 4-5, the posts 111 respectively protrude outwardly from the rear ends of the two side walls of the male base 11. Two protrusions 112 respectively protrude outwardly from front ends of the two side walls of the male base 11. A driving part 113 extends backwardly from an upper surface of the male base 11. A plurality of terminal slots 114 is defined in a front end of the male base 11. In the present embodiment, three terminal slots 114 are defined. The three male terminals 12 are correspondingly received in the three terminal slots 114, and the cables 3 are plugged in the terminal slots 114 for connecting to the male terminals 12.

Please refer to FIGS. 2 and 4, the female base 21 comprises a bottom surface 211. Two side walls 213 respectively extend upwardly from two sides of the bottom surface 211. A stopping part 212 extends upwardly from a rear end of the bottom surface 211. A plurality of locking holes (not shown) is defined in the stopping part 212. The female terminals 22 are locked in the locking holes. Two locking slots 214 are respectively defined in the middles of the two side walls 213. The locking slots 214 respectively comprise a sliding groove 214*a* which is tilting and a latching slot 214*c* which is horizontal. A latching part 214*b* which protrudes inwardly connects the sliding groove 214*a* to the latching slot 214*c*. The two latching parts 214*b* are parallel. Each of the latching slots 214*c* expands outwardly from one end of the latching part 214*b* such that the lowest point of the latching slot 214*c* is lower than a border point between the latching part 214*b* and the latching slot 214*c*. Two guiding slot 215 are respectively and recessedly defined on top surfaces of the side walls 213. The guiding slots 215 respectively communicate with the sliding grooves 214*a*. When the male base 11 is locked with the female base 21, the guiding slots 215 respectively guide the posts 11 to slide into the sliding grooves 214*a*. Then, the male base 11 is pushed, and the posts respectively slide in the corresponding sliding grooves 214*a* which are tilting. Finally, the posts 111 respectively pass the corresponding latching parts 214*b*, and thus the posts 111 are respectively locked with the corresponding latching slots 214*c*. Furthermore, two notches 216 are respectively and recessedly formed in two border locations between the two side walls 213 and a front end of the bottom surface 211 of the female base 21 for being locked with the corresponding protrusions 112 of the male base 11. When the male base 11 is locked with the female base 21, the driving part 113 is supported by the stopping part 212 and projects beyond the stopping part 212.

Figure 6:
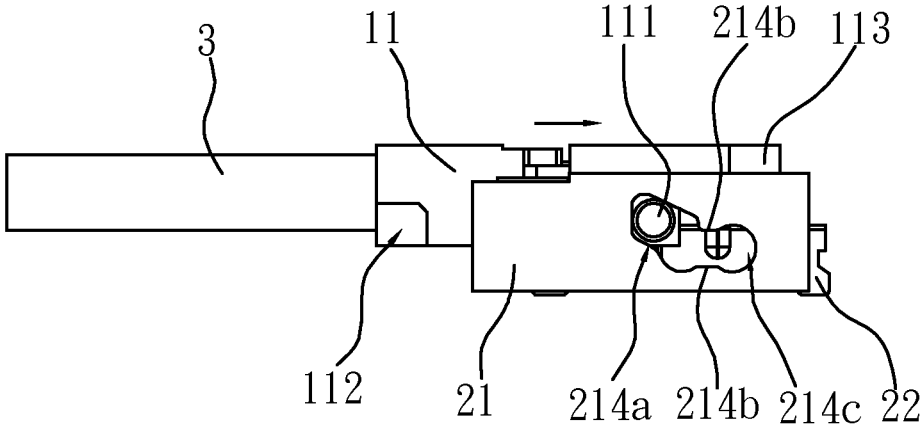
FIG. 6 is a state diagram of the cable connector before the cable connector is locked in accordance with the present invention.
Figure 7:
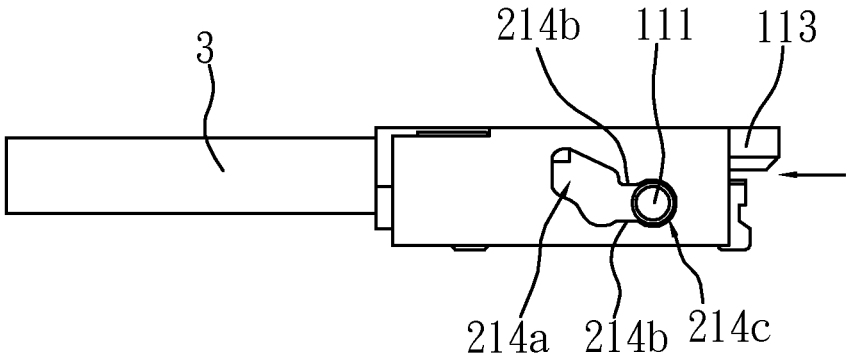
FIG. 7 is a state diagram of the cable connector after the cable connector is locked in accordance with the present invention.

Please refer to FIGS. 5-7, which show assembled and disassembled processes of the cable connector in accordance with the present invention. Before the male base 11 is attached to the female base 21, the male terminals 12 are received in the terminal slots 114 of the male base 11, and the cables 3 are plugged in the terminal slots 14 and contact with the male terminals 12. The female terminals 22 are locked with the stopping part 212 of the female base 21. To assemble the male base 11 with the female base 21, the female base 21 supports the male base 11, and the posts 111 are respectively matched with the corresponding slots 215. The guiding slots 215 respectively guide the corresponding posts 111 to slide into the corresponding sliding slots 214*a*. Then, the male base 11 is pushed along an arrow direction as shown in FIG. 6, so that the posts 111 of the male base 11 respectively slide in the corresponding sliding slots 214*a*. When keeping on pushing the male base 11, the posts 111 respectively pass the corresponding latching parts 214*b* and slide into the corresponding latching slots 214*c*. Finally, the posts 111 are respectively locked with the corresponding latching slots 214*c*, and thus the male base 11 is locked with the female base 21. Furthermore, when the male base 11 slides forwardly, the protrusions 112 respectively slide in the corresponding notches 216 of the female base 21 as well. The posts 111 are respectively locked with the corresponding latching slots 214*c*, while the protrusions 112 are respectively locked with the corresponding notches 216. The notches 216 function to prevent the male base 11 from moving upwardly. The driving part 113 in the rear end of the male base 11 projects beyond the female base 21. The locking slots 214 are tilting, the latching parts 214*b* protrude inwardly, and the protrusions 112 are locked with the corresponding notches 216, so that the male base 11 is locked with the female base 21 well. Compared with the conventional direct plug-in method, the male base 11 of the present invention is not easily removed from the female base 21 even if the cables 3 are pulled and dragged upwardly.

When the male connector 1 is required to be disassembled from the female connector 2, the driving part 113 of the male base 11 is pushed along an arrow direction as shown in FIG. 7 so that the male base 11 slides along the arrow direction. The posts 111 respectively pass the corresponding latching parts 214*b*, and then the posts 111 are respectively withdrawn from the corresponding latching slots 214*c*. Accordingly, the male base 11 is disassembled from the female base 21. Compared with the conventional disassembled method by pulling and dragging the cables 3, the male base 11 of the present invention is disassembled from the female base 21 by pushing the male base 11. Accordingly, the cables of the present invention 3 are not broken, and the electrical connection performance of the cable connector is improved.

As mentioned above, the cable connector in accordance with the present invention comprises the male connector 1 and the female connector 2. The male connector 1 comprises the male base 11 and the male terminals 12 received in the male base 11. The male terminals 12 are connected to the cables 3. The female connector 2 comprises the female base 21 and the female terminals 22 locked with the female base 21. The two posts 111 respectively protrude outwardly from ends of the two side walls of the male base 11. The two locking slots 214 which are tilting are respectively defined on the two side walls 213 of the female base 21 for corresponding to the posts 111. The posts 111 are respectively locked with the corresponding locking slots 214. The male terminals 12 contact with the female terminals 22. When the male base 11 is assembled to the female base 21, the male base 11 is pushed along a direction so that the posts 111 respectively slide in the corresponding locking slots 214 and are locked with the locking slots 214. When the male base 11 is disassembled from the female base 21, the male base 11 is pushed along another direction opposite to the direction so that the posts 111 are respectively withdrawn from the corresponding locking slots 214. Accordingly, the male base 11 is disassembled from the female base 21. Compared with the conventional direct plug-in method, the posts 111 of the present invention are steadily locked with the locking slots 214. Furthermore, the male base 11 is disassembled from the female 21 by pushing the male base 11, and thus the cables 3 are not broken and the electrical connection performance of the cable connector is improved.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A cable connector, comprising a male connector and a female connector, the male connector comprising a male base and a plurality of male terminals received in the male base, the male terminals connected to a plurality of cables, the female connector comprising a female base and a plurality of female terminals locked with the female base, wherein two posts respectively protrude outwardly from ends of two side walls of the male base, two locking slots which are tilting are respectively defined on two side walls of the female base for corresponding to the posts, the posts are locked with the locking slots, two guiding slots are recessedly defined on top surfaces of the side walls of the female base, the guiding slots respectively communicate with the corresponding locking slots, the guiding slots respectively guide the corresponding posts into the corresponding locking slots, and the guiding slot are respectively locked with the corresponding locking slots, and the male terminals contact with the female terminals.

2. The cable connector as claimed in claim 1, wherein the locking slots respectively comprise a sliding groove which is tilting and a latching slot which is horizontal, the sliding groove communicates with the corresponding guiding slot and the latching slot, a latching part which protrudes inwardly connects the sliding groove with the latching slot, a lowest point of the latching slot is lower than a border point between the sliding groove and the latching slot, and the posts respectively slide along the corresponding sliding grooves, pass the corresponding latching parts, and are locked with the corresponding locking slots.

3. The cable connector as claimed in claim 1, wherein a driving part extends outwardly from an upper surface of the ends of the side walls of the male base where the posts respectively protrude outwardly, when the male base is locked with the female base, the driving part projects beyond the female base.

4. The cable connector as claimed in claim 1, wherein two protrusions respectively protrude outwardly from the other two ends of the two side walls of the male base, and two notches are respectively and recessedly formed in ends of two side walls of the female base for being locked with the corresponding protrusions of the male base.

5. The cable connector as claimed in claim 4, wherein a plurality of terminal slots is defined in the other two ends of the side walls of the male base where the protrusions respectively protrude outwardly, the male terminals are received in the terminal slots, and the cables are plugged in the terminal slots for connecting to the male terminals.

* * * * *